US005400531A

United States Patent [19]

Brown

[11] Patent Number: 5,400,531

[45] Date of Patent: Mar. 28, 1995

[54] EXCAVATOR DEVICE

[76] Inventor: Hilton T. Brown, 9 Mars Street, Epping New South Wales 2121, Australia

[21] Appl. No.: 139,336

[22] Filed: Oct. 19, 1993

Related U.S. Application Data

[63] Continuation of Ser. No. 932,595, Aug. 20, 1992, abandoned.

[51] Int. Cl.[6] ..... E02F 3/76

[52] U.S. Cl. ..... 37/468; 414/723

[58] Field of Search ..... 414/723; 37/231, 443, 37/468, 379, 411, 403

[56] References Cited

U.S. PATENT DOCUMENTS

| | | | |
|---|---|---|---|
| 4,013,182 | 3/1977 | Pratt et al. . | |
| 4,116,346 | 9/1978 | Uchida . | |
| 4,116,347 | 9/1978 | Uchida . | |
| 4,243,356 | 1/1981 | Takojima . | |
| 4,436,477 | 3/1984 | Lenertz et al. | 37/117.5 X |
| 4,674,945 | 6/1987 | Huldén | 37/117.5 X |
| 4,790,084 | 12/1988 | Anderson et al. | 37/117.5 |
| 4,813,163 | 3/1989 | Livingston et al. | 37/103 |
| 5,082,389 | 1/1992 | Balemi | 37/117.5 X |
| 5,088,213 | 2/1992 | Raimondo et al. | 37/103 |
| 5,111,602 | 5/1992 | Risch | 37/117.5 |

FOREIGN PATENT DOCUMENTS

| | | |
|---|---|---|
| 324217 | 8/1975 | Austria . |
| 2734972 | 9/1978 | Germany . |
| 3234019 | 3/1984 | Germany . |
| 2169582 | 7/1986 | United Kingdom . |
| 08234 | 7/1990 | WIPO . |

*Primary Examiner*—Randolph A. Reese
*Assistant Examiner*—Spencer Warnick
*Attorney, Agent, or Firm*—Flehr, Hohbach, Test, Albritton & Herbert

[57] ABSTRACT

An excavator or earth-working device comprising a forked dipper arm, a linkage and an earth-working implement pivotally connected to the forked dipper arm and linkage and articulatable about the free end of the dipper arm. The implement is attached to the dipper arm and linkage of the earth-working device by a so-called "quick-hitch" connection to allow interchange between various earth-working implements. A safety device may also be provided on the "quick-hitch" connection to prevent accidental detachment of the implement from the dipper arm and linkage.

13 Claims, 6 Drawing Sheets

EXCAVATOR DEVICE

This is a continuation of application Ser. No. 07/932,595, filed Aug. 20, 1992, now abandoned.

FIELD OF THE INVENTION

The present invention relates to earth working apparatus and in particular to "quick-hitch" connections for attaching implements to such earth working apparatus.

BACKGROUND OF THE INVENTION

In earth working or excavating the equipment used can be both large and expensive. It is preferred, therefore, that one piece of machinery perform several tasks. For example, breaking of the rock surface or over-burden, removal of soil, gravel, stones etc., land filling or soil replacement and levelling. Different tasks require different implements to be attached to the basic machinery so that each task may be efficiently performed. For example, the breaking up of stones or bitumen requires a jack hammer to be connected to the machinery. Similarly, movement of loose material such as soil, sand or gravel requires the use of a shovel or bucket. Finally, a fork means may be required for removal of large rocks or levelling of the land.

Earth working implements are usually pivotally connected to the dipper arm of the machinery and are articulatable about the end of the dipper arm by means of an appropriate linkage. In this way, the angle of incidence of the implement on the ground is adjustable and, in the case of a bucket or shovel, the implement may be rotated about the free end of the dipper arm to scrape or pick up and retain material.

Several different mechanisms for attaching the different implements to the earth working apparatus have been previously proposed. Virtually all, however, have disadvantages since they require precise control of the earth working apparatus in order to align apertures on the dipper arm and linkages with complementary apertures on the implement. A pin or axle is then usually inserted through these apertures to hold the implement in place.

This method is not only tedious and difficult to perform quickly, but requires all implements to be used on one machine to have matched aperture sizes and spacings to allow interchange of these implements.

The difficulties associated with attaching implements to the earth working machinery have led to the development of "quick-hitch" connections which allow for easier removal and/or replacement of the implement.

Previously proposed "quick hitch" systems have reduced the break out force applied by the implement to the earth due to an increase in the distance between the axis of rotation of the bucket and the free edge of the bucket.

Many previous "quick hitch" connections require that substantial changes or modifications be made to either the dipper arm and linkage or the implement which adds further inconvenience and cost.

For example, most previously proposed "quick-hitch" attachments are unsuitable for use with forked dipper arms. A forked dipper arm comprises a main strut with, usually, two parallel furcations or sub-struts extending from the main strut connected to the implement. These forked dipper arms are used to reduce twisting associated with the dipper arm when in use.

With single beam dipper arms, the "quick-hitch" connections must be placed on the outside of the dipper arm so as not to interfere with movement of the implement relative to the dipper arm. However, the placement of the "quick-hitch" connections on the outside of the dipper arm makes these connections liable to damage and additionally forces the operator to use an implement or bucket which is at least as wide as the outer periphery of the "quick-hitch" connections.

Such a "quick-hitch" attachment, designed for a single beam dipper arm, will simply not operate effectively on an earth working apparatus with a forked dipper arm since the adjustment mechanism will interfere with the furcations or sub-struts of the forked dipper arm.

Most "quick-hitch" connections also rely on some form of extendible members eg. mechanical or screw extenders or actuators, hydraulic rams etc. to clamp or hold the earth working implement on the dipper arm and linkage. While most equipment used for such "quick-hitch" connections is reliable, the sheer weight of the implement attached or loss of power to the clamping mechanism may result in detachment of the earth working implement from the dip arm and linkage with disastrous results.

Clearly there is a need for some form of attachment device which not only allows for easier and more rapid attachment of the implement to a forked dipper arm of an earth working apparatus but allows some latitude in the manufacture of different types of implements that may all be used on the same earth working apparatus, does not require any major alterations to the implement, and reduces the amount of damage caused to the attachment when used.

Further, there is a need for some form of safety device or back-up mechanism which ensures reliable connection of the earth working implement to the dip arm and linkage.

In an effort to ameliorate the disadvantages of the prior art it is proposed to provide a means of attachment of an implement to an earth working apparatus which offers a choice over the prior art and which, at least in the preferred embodiment, provides a method and means of attachment which is both easier and more rapid and reliable to use and manufacture while providing equivalent performance in its intended environment.

SUMMARY OF THE INVENTION

In a first aspect, the present invention provides an improvement in an earth working apparatus in which an implement is pivotally connected to the free ends of a forked dipper arm and to a linkage such that the implement is articulatable about its pivotal connection with the forked dipper arm, a "quick-hitch" connecting the forked dipper arm and the linkage to the implement, the "quick-hitch" comprises engagement members on or adjacent the free ends of each of the dipper arm and the linkage, complementary engagement means on the implement and a strut means of adjustable length extending between the forked dipper arm and the linkage to releasably hold the engagement means of the forked dipper arm and linkage in engagement with the complementary engagement means of the implement, the strut means being connected to the engagement means of the forked dipper arm between the free ends of the forked dipper arm.

In a second aspect, the present invention comprises an earth working apparatus having a forked dipper arm with at least two free ends and an implement pivotally connected to the forked dipper arm and a linkage, the implement being articulatably movable about the free ends of the forked dipper arm, a first engagement means located on or adjacent the free ends of the forked dipper arm, a second engagement means located on or adjacent a free end of the linkage, complementary complementary engagement means on said implement, an adjustment means being connected between the forked dipper arm and the linkage to adjust the distance between the first and second engagement means and releasably connect the first and second engagement means with the complementary engagement means of the implement, the adjustment means being connected to the engagement means of the dipper arm between the free ends of the dipper arm.

In a third aspect, the present invention comprises a "quick-hitch" connection for connecting an implement to a forked dipper arm and linkage of an earth working device whereby the implement is pivotally connected to the free ends of the forked dipper arm and to the linkage of the earth moving device and is articulatable about its pivotal connection with the forked dipper arm, the "quick-hitch" connection comprising:

(a) engagement members on or adjacent the free ends of the fork dipper arm and the linkage, (b) complementary engagement means on the implement, (c) a strut means of adjustable length extending between the forked dipper arm and the linkage to releasably hold the engagement means of the forked dipper arm and linkage in engagement with the complementary engagement means of the implement, and (d) a substantially rigid prop means reciprocable between a first release position, in which the forked dipper arm and the linkage are free to move in response to alteration of the length of the strut means to hitch or unhitch the implement, and a second locking position, in which the prop means extend between the forked dipper arm and linkage to prevent alteration of the length of the strut means and relative movement of the engagement means of the forked dipper arm and the linkage.

In a first embodiment, the engagement means of the forked dipper arm and linkage comprise a pair of substantially parallel pins, the complementary engagement means of the implement comprising two sets of axially aligned hooks.

In another embodiment, the engagement means of the forked dipper arm and linkage comprise axially aligned hooks, the complementary engagement means of the implement comprising a pair of substantially parallel pins.

In a further embodiment, the forked dipper arm of the earth working apparatus comprises a main strut member with two furcations extending therefrom, a substantially U-shaped portion being formed between said furcations.

In another embodiment, the adjustment means or strut means comprises at least one hydraulic ram, connected to the mid point of the pins.

In a further embodiment, the adjustment means or strut means comprises a plurality of substantially parallel hydraulic rams.

In another embodiment, free ends of the hydraulic rams are connected to a pin on or adjacent the free end of the forked dipper arm by a triangular plate, the plate being connected to the pin by a cylindrical sleeve at one apex of the plate, the free ends of the hydraulic rams being connected at the other apices of the plate.

In still another embodiment, the prop means is pivotally connected to the strut means or the forked dipper arm or the linkage for rotation between the first release position and the second locking position.

In still a further embodiment the prop means comprises an elongated channel member of inverted U-shaped cross-section, the strut means being received in the channel member when the prop means is in the second locking position.

To assist in placement of the prop means, the engagement means of the forked dipper arm or the linkage may include an arcuate guideway to slidingly receive the prop means.

In yet another embodiment, rotation of the prop means may be effected by an extendible arm connected to the prop means at a point spaced from the pivotal connection of the prop means to the forked dipper arm, the linkage or the strut means.

The improvement in the earth working apparatus according to the present invention allows for easier and more rapid removal and replacement of an implement on the earth working apparatus with a forked dipper arm.

To connect an implement to the earth working apparatus according to the present invention, firstly the forked dipper arm is lowered and engages a first complementary engagement means of the implement. The linkage may then easily engage a second complementary engagement means on the implement by operation of the adjustable strut to engage the engagement means of the linkage with the complementary engagement means of the implement. A firm connection is achieved by appropriate adjustment of the strut.

By having the adjustable means or strut connected to the engagement means of the forked dipper arm at a point between the free ends of the forked dipper arm, relative movement between the dipper arm and the implement can occur unhindered, to assist hitching and unhitching of the implement.

In addition, the connection of the adjustable means or strut between the free ends of the forked dipper arm, allows the adjustment means to be very narrow as compared to prior art "quick-hitch" connections and preferably narrower than the dipper arm itself.

This in turn produces a "quick-hitch" connection which is not as liable to be damaged in use, since no part of the adjustable strut extends outside the outer surface of the dipper arm, unlike previous "quick-hitch" connections. The inventive "quick-hitch" connection also allows the fitting of implements or buckets which are only slightly wider than the dipper arm itself, whereas prior art "quick-hitch" connections must be much wider than the dipper arm to accommodate the "quick-hitch" connections on the sides of the dipper arm.

Once the implement is connected, the prop means may be brought into its locking position from its release position. In this locking position between the forked dipper arm and the linkage, the substantially rigid prop means prevents alteration of the length of the strut means. In essence, therefore, the engagement means of the forked dipper arm and the linkage are locked into position to prevent detachment from the complimentary engagement means of the implement. Even if the strut means fails, for example, if power is lost or extension or retraction of the strut means is accidentally actuated, alteration of the length of the strut means is prevented by the rigid prop means which blocks any relative movement of the engagement means of the dipper arm and the linkage to thereby maintain connection of the implement with the forked dipper arm and linkage of the earth working device.

BRIEF DESCRIPTION OF THE DRAWINGS

In order that the nature of the present invention may be more clearly understood, preferred embodiments of the invention will now be described, by way of example only, with reference to the accompanying drawings in which.

DESCRIPTION OF THE PREFERRED EMBODIMENTS

Figure 1:
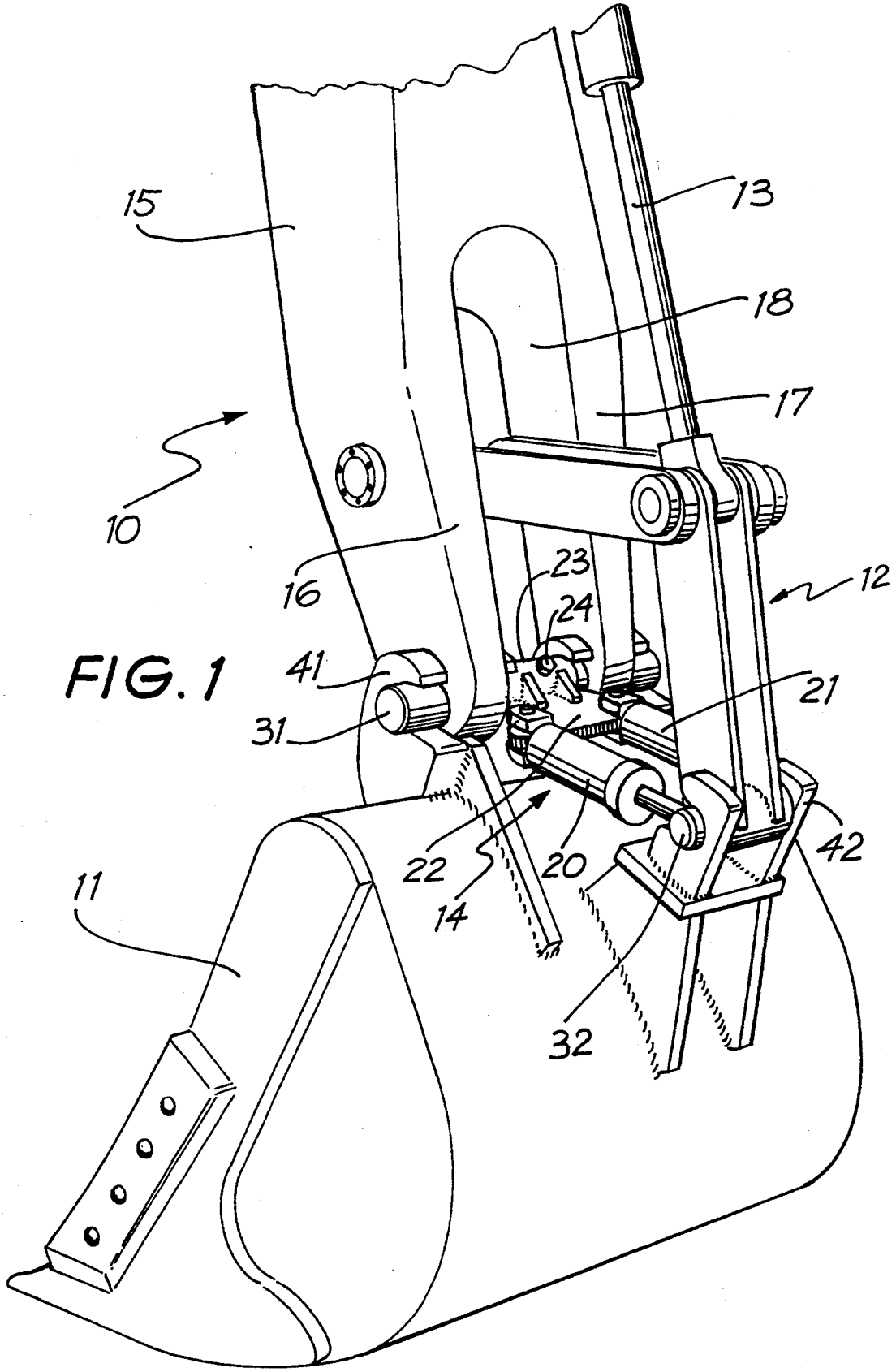
FIG. 1 is a perspective view of a portion of an earth working apparatus in accordance with an embodiment of the present invention.

Turning firstly to FIG. 1, the present invention comprises an improvement in earth working apparatus comprising a dipper arm 10, an implement 11 and linkage 12.

The implement 11 is articulatably pivotal around the dipper arm 10 in response to movement of the linkage 12 by hydraulic ram 13.

Forked dipper arm 10 comprises main a strut member 15 with furcations or sub-strut members 16,17 extending therefrom. A substantially U-shaped portion 18 is thereby formed between the furcations.

Figure 2:
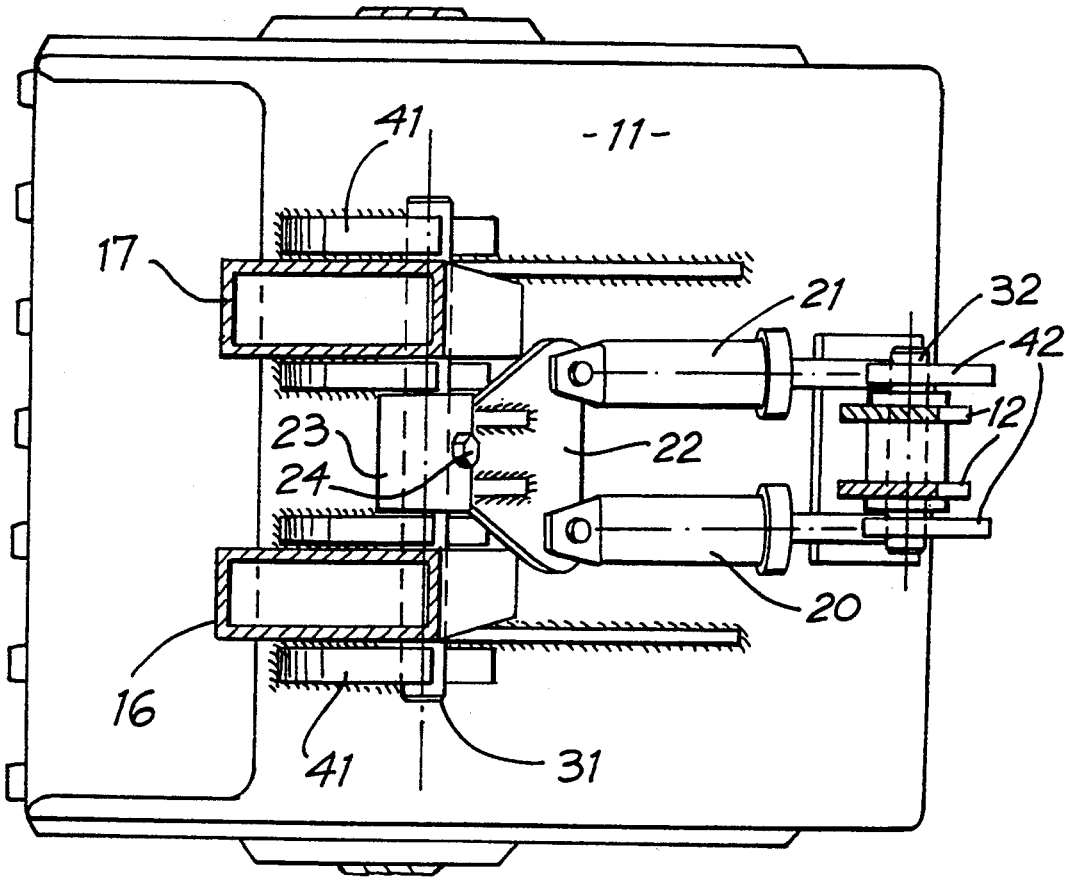
FIG. 2 is a front elevational view of the "quick-hitch" connection between an implement and the earth working apparatus, in accordance with an embodiment of the present invention.

An adjustable strut 14 extends between the free ends of dipper arm 10 between furcations 16,17 and the free end of linkage 12. As can be seen in FIG. 2, the adjustable strut 14, in this case, comprises two substantially parallel hydraulic rams 20 and 21.

An engagement means 31, in this case a pin, extends transversely through the free ends of the dipper arm 10. One end of hydraulic rams 20,21 are connected to pin 31 at a position between the free ends of dipper arm 10. In the embodiment shown, a cylindrical sleeve 23 extends around pin 31 and is attached to one apex of triangular plate 22, the other apices of triangular plate 22 being connected to the hydraulic rams 20 and 21. The cylindrical sleeve 23 acts as a bushing around pin 31 and bolt 24 ensures that sleeve 23 and plate 22 are not rotatably held on pin 31.

The other end of hydraulic rams 20 and 21 are connected to the engagement means 32 of linkage 12.

The implement 11 incorporates engagement means for connecting the implement 11 with the free ends of dipper arm 10 and linkage 12. In this case, the engagement means of the implement 11 comprise two sets of axially aligned hooks 41, 42, the axes of these apertures being substantially parallel but spaced from each other.

It will be clear to the person skilled in the art, therefore, that engagement of pin 31 with axially aligned hooks 41 and engagement of pin 32 with axially aligned hooks 42 will connect the implement 11 with the free ends of dipper arm 10 and linkage 12.

The fit of engagement means 31 and 32 with complementary engagement means 41 and 42 respectively, may be adjusted by appropriate manipulation of adjustable strut 14. In practice, one engagement means, for example pin 31 will engage one complementary engagement means on the implement, for example hooks 41. Strut 14 will then be adjusted so that the second engagement means, for example pin 32, engages reliably with complementary engagement means on implement 11, for example, hooks 42.

Once the engagement means of the dipper arm 10 and linkage 12 are engaged with complementary engagement means on implement 11 the adjustable strut 14 may be locked in position.

Figure 3:
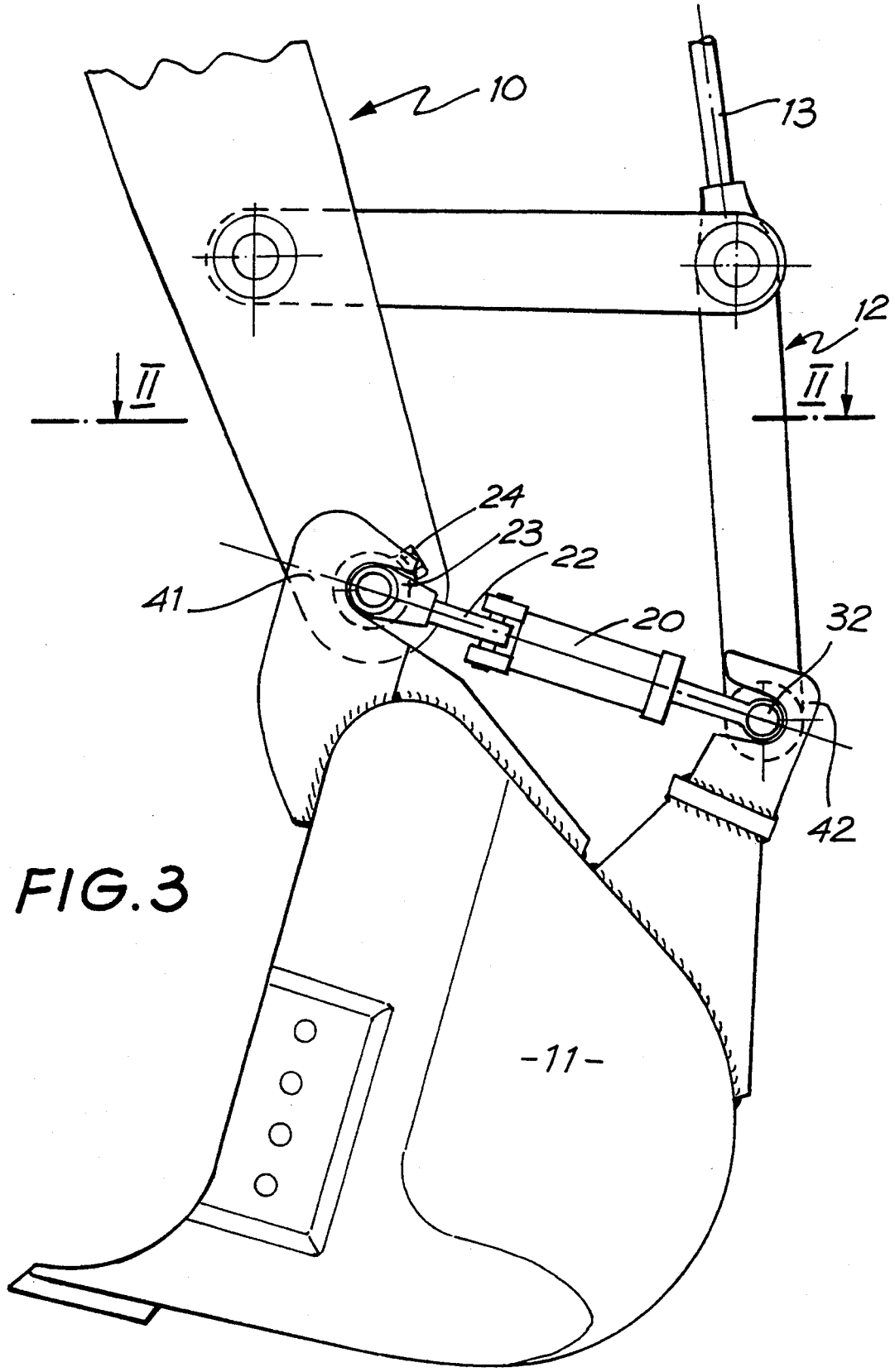
FIG. 3 is a side elevational view of the "quick-hitch" connection shown in FIG. 2.

The device shown in FIGS. 2 and 3 clearly shows how dipper arm 10 and linkage 12 are adjusted by means of strut 14 to provide contact of the engagement means 31, 32 with complementary engagement means 41, 42 on the implement 11.

Figure 4:
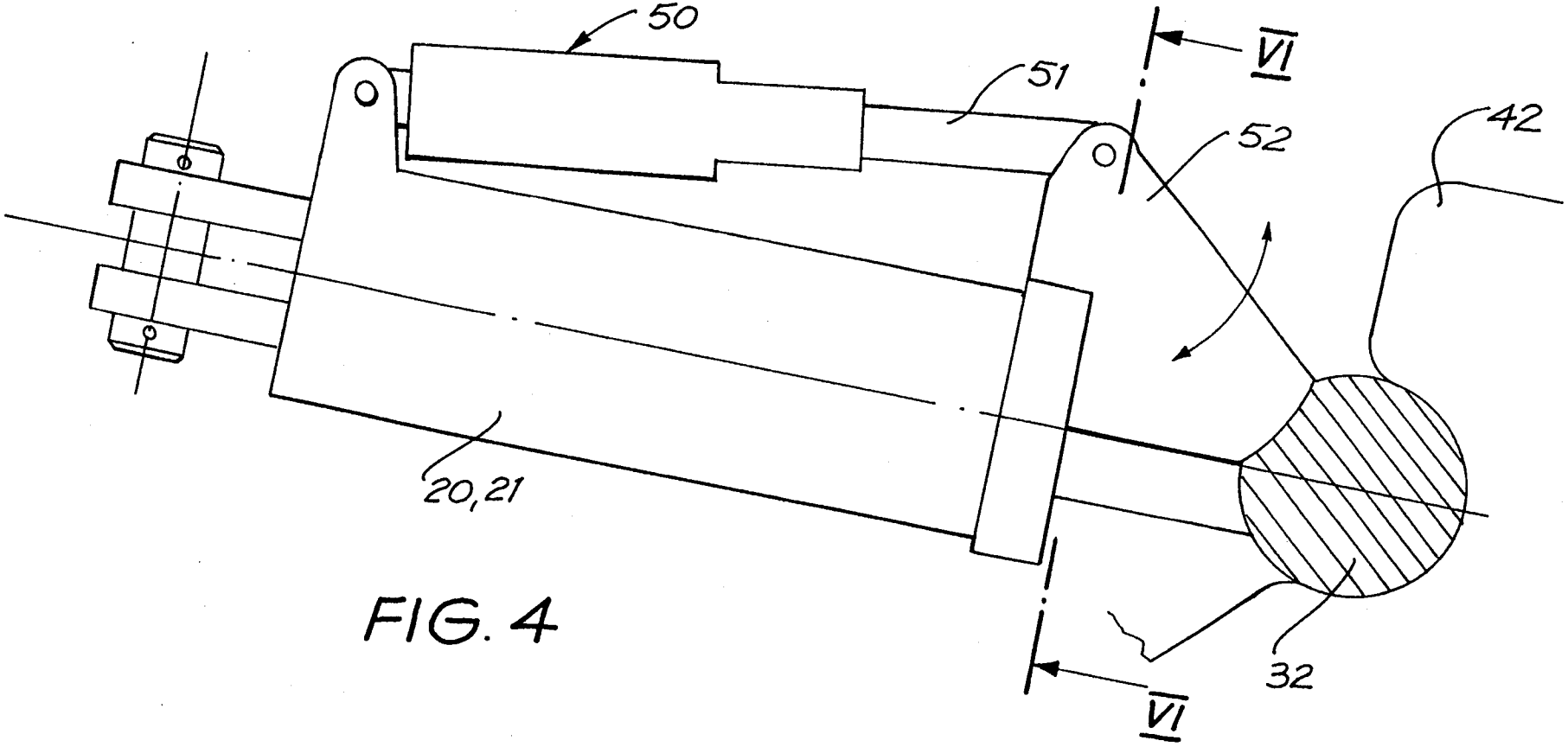
FIGS. 4 and 5 are side elevational views of a "quick-hitch" connection according to another embodiment of the present invention.

FIG. 4 shows another embodiment of the present invention wherein a "quick-hitch" connection is provided which includes a safety mechanism to prevent accidental disengagement of the implement 11 from the dipper arm 10 and linkage 12. As with FIGS. 1–3, the implement 11 is attached to the dipper arm 10 and linkage 12 by means of engagement of pins 31, 32 with hooks 41, 42 respectively. These pins are normally held in engagement with the hooks by means of adjustable strut 14, in this case a pair of hydraulic cylinders 20, 21. However, if adjustable strut 14 fails, or it is accidentally retracted, pins 31 or 32 may disengage from hooks 41 or 42 and the implement 11 may detach from dipper arm 10 and linkage 12. This, of course, is highly undesirable as not only may the implement 11, dipper arm 10 or linkage 12 be damaged, but dropping such a heavy implement may lead to injury or loss of life.

To ensure that reliable connection of the implement, therefore, the present invention provides a substantially rigid prop means 50 which is reciprocable between a first or release position and a second or locked position. In FIG. 4, the prop means 50 is shown in its locked position extending between dipper arm 10 and linkage 12. The prop means 50 is pivotally connected to hydraulic ram 20 of strut 14 such that retraction or extension of reciprocable arm 51 rotates member 54 between a first or release position and a second or locking position.

In the locked position as shown in FIG. 4, member 52 is wedged between pin 32 and the end of hydraulic ram 20. An identical prop means may be mounted on second hydraulic ram 21. Any alteration of the length of strut means 14 is impossible, therefore, since extension is limited by hooks 41, 42 and retraction is prevented by prop means 50 when in the locked position of FIG. 4. Thus, accidental disengagement of implement 11 from dipper arm 10 and linkage 12 is prevented.

Retraction of arm 51 will rotate member 52 to its release position at say 45° from the locked position shown in FIG. 4. In such a release position, pins 31 and 32 are free to move in response to alteration of the length of strut means 14 to hitch or unhitch implement 11, as outlined above.

Figure 6:
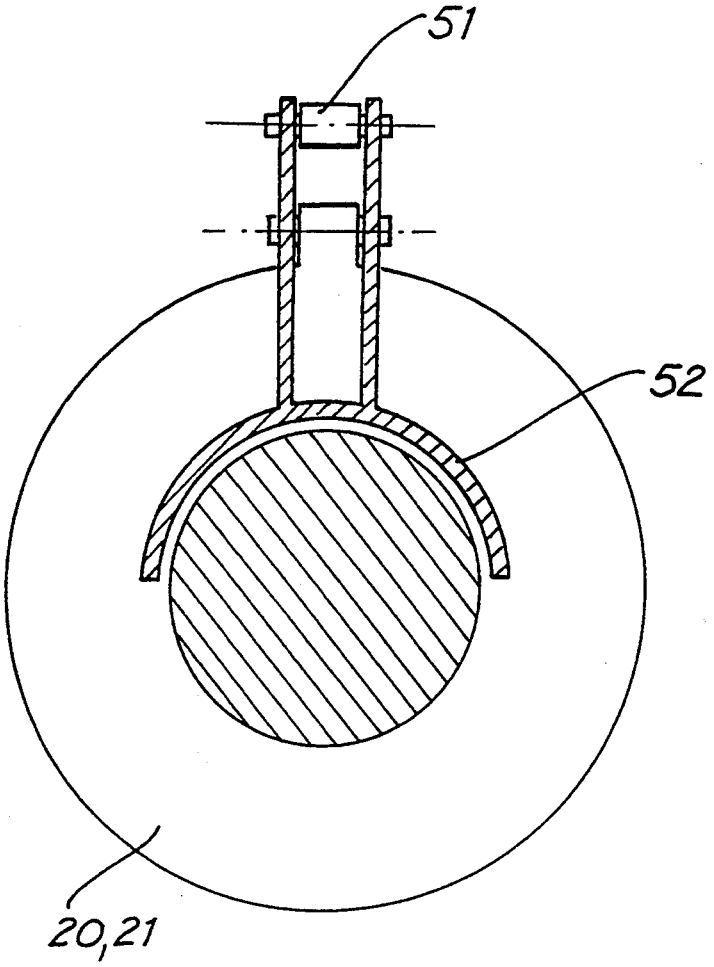
FIG. 6 is a cross-sectional view taken along the line 6—6 of FIG. 4.

Member 54 is preferably formed as a channel member of inverted U-shape such that in its locked position shown in FIGS. 4 and 6, the ram of hydraulic cylinder 20 is received within the channel section. Not only does this allow the member 51 to contact pin 32 and the end of hydraulic cylinder 20 on both sides of the ram, but it protects the ram of hydraulic cylinder 20 from damage which may occur during use.

It is preferred that extendible arm 51 is controlled independently of hydraulic cylinder 20 and most preferably uses a different power source such that if power is lost to hydraulic cylinder 20 this does not effect operation of arm 51. Most preferably, extendible arm 51 comprises a linear actuator or extendible screw.

Figure 5:
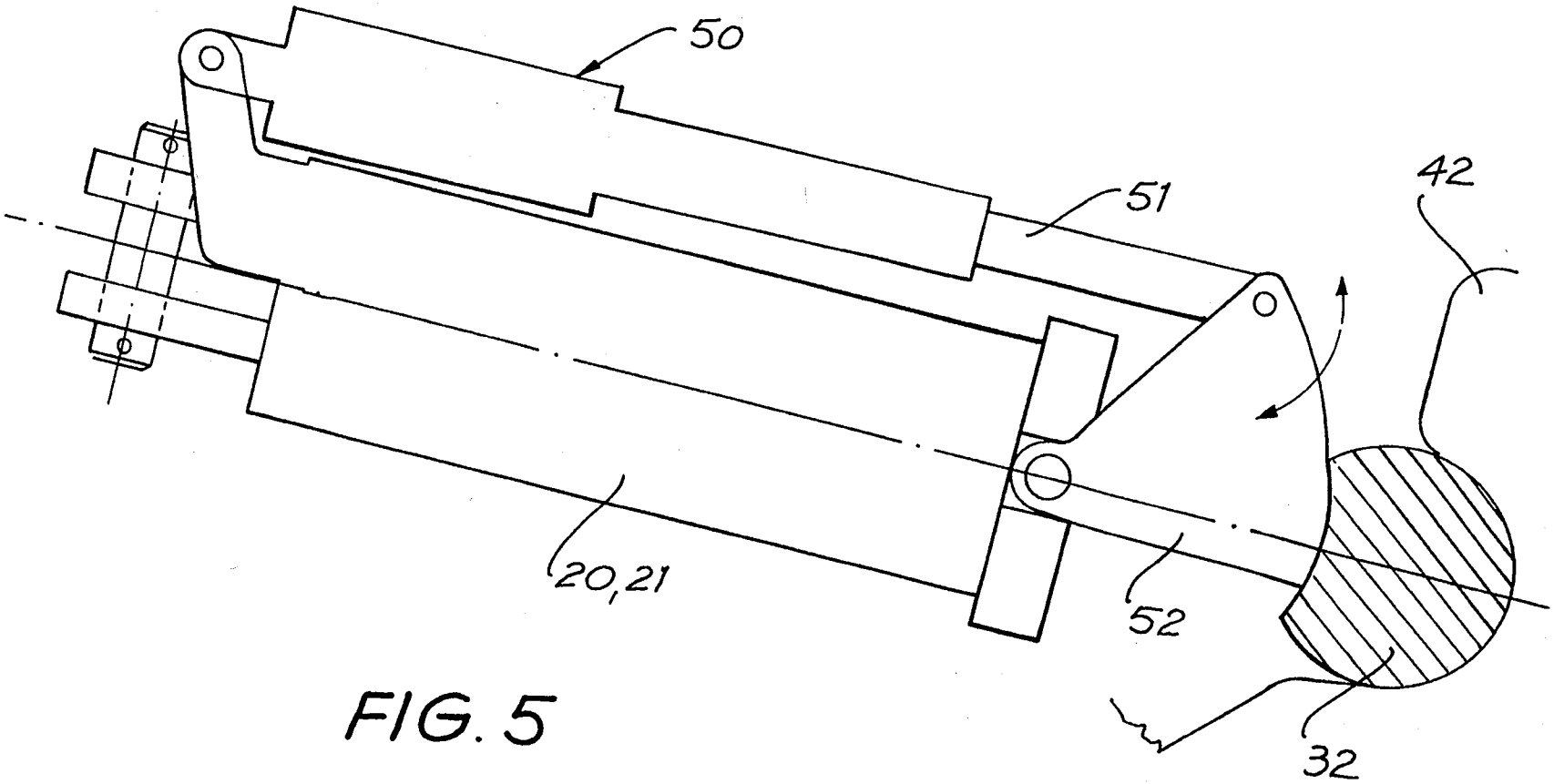

Turning now to FIG. 5, an alternative embodiment of "quick-hitch" connection according to the present invention is shown wherein prop means 50 once again comprises member 55, however, in this case member 55 is formed as a plate member that is pivotally connected to and rotates along one side of hydraulic cylinder 20. Apart from this difference between the embodiments shown in FIGS. 4 and 5, they operate in precisely the Same manner ie. retraction or extension of extendible arm 51 rotates member 55 between its release and locked position to allow and prevent respectively relative movement of pin 31 and 32 for detachment or attachment of implement 11 to dipper arm 10 and linkage 12.

To assist and ensure reliable contact between member 55 and, in this case, pin 32, the pin is provided with an arcuate guideway to slidingly receive member 55 as it rotates between its release and locked positions.

It will be clear to the person skilled in the art that any type of implement may be connected to the dipper arm 11 and linkage 12 using the inventive connection. The implement shown in this embodiment is a bucket or shovel. A similar "quick-hitch" connection may be incorporated with a jack hammer, raking fork etc, slight variations being incorporated into the positioning of the engagement means on the implement.

It will also be clear to persons skilled in the art that by connecting the hydraulic rams 20 and 21 to the engagement means 31 of dipper arm 10 at a point between sub-strut members 16 and 17, the "quick-hitch" connection of the present invention does not interfere with the movement of implement 11 relative to dipper arm 10.

Additionally, by connecting the hydraulic rams 20 and 21 to a point between furcations members 16 and 17, the "quick-hitch" connection may be quite narrow, as compared to prior "quick-hitch" connections and preferably narrower than the width of dipper arm 10. In this way, when implement 11 is forced into the ground, the furcations 16 and 17 protect hydraulic rams 20 and 21 from damage.

A further advantage of the present invention arrives from the fact that, since hydraulic rams 20 and 21 are not placed on the outside of dipper arm 10, it is possible to use a bucket or implement 11 which is only slightly wider than dipper arm 10. Prior art "quick-hitch" connections, on the other hand, require substantially wider buckets due to the fact that the "quick-hitch" connections must be on the outside of the dipper arm.

It should also be noted that unlike previous "quick hitch" connections, there is no reduction in break out force since there is no alteration of the distances between the pivotal connections of the dipper arm 10, implement 11 and linkage 12.

In the embodiments shown, the adjustable strut 14 is shown as a pair of parallel hydraulic rams 20 and 21 working in compression. It will be clear to the person skilled in the art, however, that if hooks 41, 42 were reversed the present inventive method would work equally as well with an adjustable strut 14 working in tension.

Equally, if hooks 41, 42 were facing outward and adjustable strut 14 worked in tension, prop means 50 may also work in tension by, for example, having slots, grooves or hooks which may be wrapped around the outside of pins 31 or 32 to prevent accidental extension of adjustable strut 14 and detachment of implement 11 from dipper arm 10 and linkage 12.

Similarly, reversal of the engagement means of the dipper arm and linkage with the complementary engagement means of the implement would still allow for easy withdrawal and replacement of the implement on the earth working apparatus. For example, if hooks 41, 42 were replaced with a pair of substantially parallel pin members and the free ends of dipper arm 10 and linkage 12 incorporated some form of hook means, the device would perform the desired function, equally as well. Indeed, any type of engagement and complementary engagement means on the implement 11 and dipper arm 10 and linkage 12 may be used to connect the implement 11 with the earth working apparatus, and any substantially rigid prop means may be used to prevent accidental detachment.

It will be recognised by persons skilled in the art that numerous variations and modifications may be made to the invention as described above without departing from the spirit or scope of the invention as broadly described.

I claim:

1. An improvement in an earth moving apparatus having a forked dipper arm and a tipping linkage, the forked dipper arm having a main support member with two struts extending therefrom, a substantially U-shaped portion being formed between said struts, an upper end Of the linkage being connected between said struts and an implement being pivotally connected to free ends of the forked dipper arm and the linkage such that the implement is articulatable about its pivotal connection with the forked dipper arm by extension or retraction of the linkage, a "quick-hitch" connecting the forked dipper arm and the linkage to the implement, which "quick-hitch" comprises engagement members carried by the free ends of each of the dipper arm and the linkage, corresponding engagement members on the implement and a beam means of adjustable length extending between the forked dipper arm and the linkage to releasably hold the engagement members of the forked dipper arm and linkage in engagement with the corresponding engagement members of the implement, characterized in that the beam means comprises a pair of substantially parallel extendable/retractable members positioned laterally outward of the linkage, one pair of ends of the extendable/retractable members being connected to the engagement members of the forked dipper arm between the free ends of the forked dipper arm, the other pair of ends of the extendable/retractable members being connected on opposite exterior sides of the linkage adjacent a free end of the linkage.

2. The improvement in an earth moving apparatus as claimed in claim 1 wherein the engagement members of the forked dipper arm and linkage comprises a pair of substantially parallel pins, the complementary engagement members of the implement comprising two sets of axially aligned hooks.

3. An improvement in an earth moving apparatus as claimed in claim 1 wherein the extendable/retractable members are hydraulic rams.

4. An improvement in an earth moving apparatus as claimed in claim 2, wherein one pair of ends of the hydraulic rams is connected to the forked dipper arm engagement pin carried by the free ends of the forked dipper arm by a triangular plate, the plate being connected to the forked dipper arm engagement pin by a cylindrical sleeve at one apex of the plate, the ends of the hydraulic rams being connected at the other apices of the plate.

5. An earth moving apparatus comprising a forked dipper arm and a tipping linkage, the forked dipper arm having a main support member with two struts extending therefrom, a substantially U-shaped portion being formed between said struts, an upper end of the linkage being connected between said struts and an implement being pivotally connected to free ends of the forked dipper arm and linkage such that the implement is articulatable about its pivotal connection with the forked dipper arm by extension or retraction of the linkage, a first engagement member being carried by the free ends of the forked dipper arm, a second engagement member being carried by a free end of the linkage, corresponding complementary engagement member being formed on said implement and an adjustment means being connected between the forked dipper arm and the linkage to adjust the distance between the first and second engagement members and releasably connect the first and second engagement members with the complementary engagement member of said implement, characterized in that said adjustment means comprises a pair of substantially parallel extendable/retractable members positioned laterally outwardly of said linkage, one pair of ends of the extendable/retractable members being connected to the first engagement means between the free ends of the forked dipper arm, the other pair of ends of the extendable/retractable members being connected on opposite exterior sides of the linkage adjacent the free end of the linkage.

6. An earth moving apparatus as claimed in claim 5, wherein the engagement members of the forked dipper arm and linkage comprise a pair of substantially parallel pins, the complementary engagement members of the implement comprising two sets of axially aligned hooks.

7. An earth moving apparatus as claimed in claim 5, wherein the adjustment means comprises a pair of substantially parallel hydraulic rams.

8. An earth moving apparatus as claimed in claim 7, wherein one pair of ends of the hydraulic rams are connected to the first engagement member pin carried by the free ends of the forked dipper arm by a triangular plate, the plate being connected to the first engagement member pin by a cylindrical sleeve at one apex of the plate, the ends of the hydraulic rams being connected at the other apices of the plate.

9. A "quick-hitch" connection for connecting an implement to a forked dipper arm and a linkage of an earth working device whereby the implement is pivotally connected to free ends of the forked dipper arm and to the linkage of the earth working device and which linkage is articulatable about its pivotal connection with the forked dipper arm, the "quick-hitch" connection comprising:

(a) engagement members carried by the free ends of the forked dipper arm and the linkage, (b) engagement members on the implement complementary to the engagement members of the free ends of the forked dipper arm and the linkage, respectively, (c) a strut means of adjustable length extending between the forked dipper arm and the linkage to adjust the distance between the ends of the forked dipper arm and linkage and thereby connect the engagement members of the forked dipper arm and linkage in engagement with the complementary engagement members of the implement (d) a substantially rigid prop means reciprocable between a released position, in which the forked dipper arm and the linkage are free to move in response to alteration of the length of the strut means to hitch or unhitch the implement, and a locking position in which the prop means extends between the forked dipper arm and linkage to prevent alteration of the length of the strut means and relative movement of the engagement members of the forked dipper arm and the linkage.

10. A "quick-hitch" connection as claimed in claim 9 wherein the prop means is pivotally connected to the strut means for rotation between the first release position and the second locking position.

11. A "quick-hitch" connection as claimed in claim 9 wherein the prop means comprises an elongate channel member of inverted U-shaped cross-section, the strut means being received in the channel member when the prop means is in the locking position.

12. A "quick-hitch" connection as claimed in claim 10 wherein the engagement member of the forked dipper arm has an arcuate guideway to slidingly receive the prop means.

13. A "quick-hitch" connection as claimed in claim 12 wherein rotation of the prop means is effected by an extendible arm connected to the prop means at a point spaced from the pivotal connection of the prop means to the strut means.

* * * * *